US005209639A

United States Patent [19]

Neuber et al.

[11] Patent Number: 5,209,639

[45] Date of Patent: May 11, 1993

[54] RADIAL FAN WITH AN AXIAL HOUSING

[75] Inventors: Rudolf Neuber, Siegburg; Karl Reither, Troisdorf-Spich, both of Fed. Rep. of Germany

[73] Assignee: KT Kunststofftechnik GmbH, Fed. Rep. of Germany

[21] Appl. No.: 740,699

[22] Filed: Aug. 6, 1991

[30] Foreign Application Priority Data

Aug. 10, 1990 [DE] Fed. Rep. of Germany ... 9011652[U]

[51] Int. Cl.[5] ..... F04D 29/42

[52] U.S. Cl. ..... 415/213.1; 415/206; 248/639

[58] Field of Search ..... 415/213.1, 203, 206, 415/200; 248/639, 646, 672

[56] References Cited

U.S. PATENT DOCUMENTS

| | | | |
|---|---|---|---|
| 2,601,030 | 6/1952 | Klein et al. | 415/177 |
| 2,689,100 | 9/1954 | Voigt | 248/672 |
| 3,117,770 | 1/1964 | Campbell | 415/210.1 |
| 3,326,503 | 6/1967 | Bade | 248/672 |
| 3,412,929 | 11/1968 | Greenheck | 415/177 |
| 3,650,633 | 3/1972 | Benoit | 415/208.2 |
| 3,752,603 | 8/1973 | Bunch | 415/200 |
| 3,950,835 | 4/1976 | Bennink et al. | 415/206 |
| 4,599,042 | 7/1986 | Colliver | 415/200 |
| 4,787,818 | 11/1988 | Bales et al. | 415/206 |
| 4,836,148 | 6/1989 | Savage et al. | 415/170.1 |

FOREIGN PATENT DOCUMENTS

| | | | |
|---|---|---|---|
| 816156 | 7/1959 | United Kingdom | 248/646 |

*Primary Examiner*—John T. Kwon
*Attorney, Agent, or Firm*—Diller, Ramik & Wight

[57] ABSTRACT

A radial fan with an axial housing, in particular for conveying chemically aggressive air and gases, the approximately circular cylindrical plastic housing of which has a rotationally symmetrical inlet funnel at one of its ends and an outlet funnel at its other end, and close behind the inlet funnel encloses a plastic impeller arranged coaxially with the latter, which possesses at its circumference apertures for the approximately radial discharge of the air or gases, conveyed by its curved guide blades, into the surrounding housing, the electromotor driving the impeller being situated inside a separately ventilated, plastic inner housing which penetrates the housing of the radial fan and is sealed with respect to the latter, has an electromotor carried by a support plate, which in turn is carried by four support columns, fastened to a baseplate, wherein the housing, together with the inner housing connected rigidly thereto, is connected detachably to this baseplate.

13 Claims, 3 Drawing Sheets 1
4
4'
4'
3
2
5
1
12
11
10
28
28
9
27
13
14
25
17
26
8
6
7
15
18
16
21
20
19
22
24
23

RADIAL FAN WITH AN AXIAL HOUSING

BACKGROUND OF THE INVENTION

The invention relates to a radial fan with an axial housing, in particular for conveying chemically aqgressive air and gases.

In a known radial fan of this type, a circular cylindrical plastic housing is provided which has a rotationally symmetrical inlet funnel at one of its ends and an outlet funnel at its other end, and close behind the inlet funnel encloses a plastic impeller arranged coaxially with the latter and which possesses at its circumference apertures for the approximately radial discharge of the air or gases, conveyed by its curved guide blades, into the surrounding housing, the electromotor driving the impeller being situated inside a separately ventilated, plastic inner housing which penetrates the housing of the radial fan and is sealed with respect to the latter. Such a radial fan is described, for example, in German Utility Model 84 16 415.

SUMMARY OF THE INVENTION

The invention is based on the object of further developing the radial fan in such a way that its housing, together with the inner housing, can be easily detached and lifted off from the driving electromotor so that necessary maintenance work can be carried out on the latter conveniently.

This object is achieved according to the invention by the electromotor being carried by a support plate which in turn is carried by four support columns fastened to a baseplate, and by the housing, together with the inner housing connected rigidly thereto, being connected detachably to this baseplate.

As will be explained in more detail below, the inlet funnel of the housing, and thus the impeller situated behind the inlet funnel, can be removed with few handling operations, and thus, after the outlet funnel has been disconnected from the adjoining pipeline, the housing of the radial fan, together with the inner housing, can be removed so that the electromotor carried by the support columns and a support plate does not need to be removed.

The inner housing surrounding the electromotor can be ventilated in various ways. Preferably, however, the baseplate carrying the support columns is at the same time the closing plate of the inner housing and is preferably provided with apertures for the inlet of cooling air, whilst the outlet of the air cooling the electromotor is effected through exhaust tubes in the side walls of the inner housing which pass through the housing of the radial fan.

In a further development of the invention, a belt drive inserted between the electromotor and the impeller shaft is provided inside the inner housing. The impeller shaft is then no longer the drive shaft but a different shaft mounted separately in bearing blocks, the bearing blocks being carried by a support plate fastened to the support columns.

The invention will be explained in more detail below in illustrative embodiments and with reference to the drawing, in which:

DESCRIPTION OF THE PREFERRED EMBODIMENTS

Figure 1:
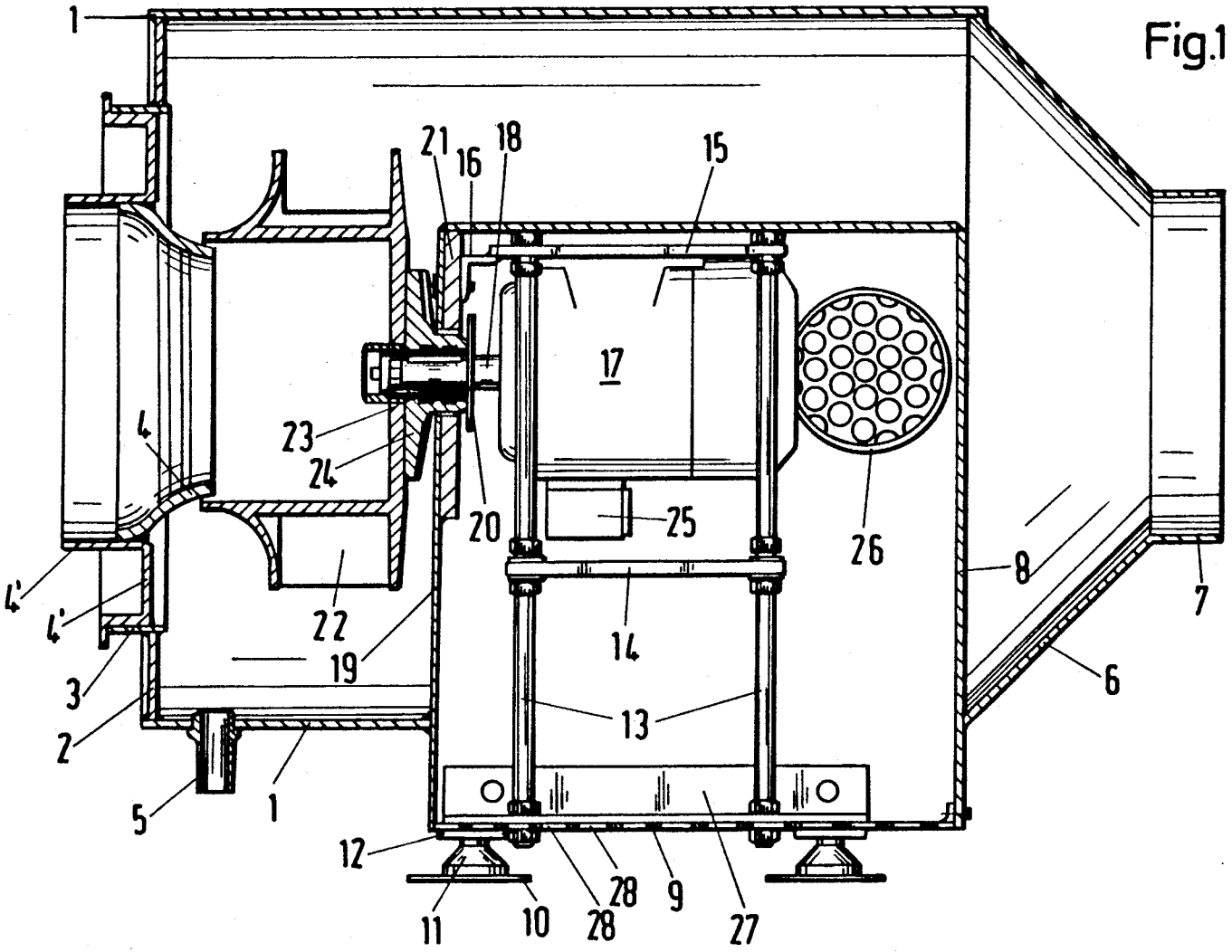
FIG. 1 shows a longitudinal section through a radial fan according to the invention with an axial housing and an inner housing.

The radial fan shown in FIG. 1 comprises an essentially circular cylindrical plastic housing 1 having a rotationally symmetrical inlet funnel 4 at one of its ends, which inlet funnel is carried by an inlet flange 4' surrounding it and is connected rigidly to this flange. The inlet flange is inserted detachably into a tubular piece 3 which is situated in the end wall 2 of the housing 1.

At the other end of the housing 1 is situated an outlet funnel 6 which merges into an outlet pipe 7 and, depending upon the cross-sectional shape of the pipe to be connected, has a circular or other cross-section.

A condensation run-off 5 in the form of a nozzle, onto which a run-off hose can be pushed, is situated in the vicinity of the end wall 2, in the shell of the housing 1.

A plastic inner housing 8 with a baseplate 9 is situated inside the housing 1. This inner housing traverses the housing 1 in the transverse direction and is connected to it airtightly. The inner housing 8 projects with its baseplate 9 out of the shell of the housing 1. The shell of the inner housing 8 is connected detachably to the baseplate 9 which is carried by two crossbeams 12 which in turn rest via anti-vibration pads 11 on support plates 10. These support plates can, depending upon the type of mounting of the radial fan, be fastened on a horizontal, inclined or vertical surface.

Two angle bars 27, only one of which is shown in FIG. 1, are situated on the baseplate 9. Four support columns 13, which are screwed rigidly to the angle bars and to the baseplate 9, are carried by these angle bars. In the central part of the inner housing 8 there is situated a support plate 14 through which the support columns pass and which is screwed to the latter and gives them additional stability.

The support columns 13 provided with an external screw thread carry at their upper ends, close to the wall of the inner housing 8, a further support plate 15 which is likewise screwed rigidly to the support columns.

An electromotor 17, whose base is screwed rigidly to the support plate 15, is arranged beneath the support plate 15.

The electrical connections of the electromotor 17 are situated in the terminal box 25, just above the support plate 14.

The drive shaft 18 extends through the aperture in the front wall 19 of the inner housing 8. This front wall is strengthened by a strengthening plate 21 with a corresponding hole. This strengthening plate carries detachably an angle bar 16 for the additional support of the support plate 15 carrying the motor 17, and which is welded to this support plate 15.

The drive shaft projects through the aperture of the inner housing 8 into the housing 1 and carries at its free end a metal sleeve 23 onto which a plastic carrying hub 24 is pushed, and is rigidly connected to the latter. In the illustrative embodiment described, the metal sleeve 23 is incorporated into the carrying hub 24 in the casting procedure. The metal sleeve is fastened nontwistably on the drive shaft 18 by a groove and tongue connection (not shown in more detail), but can when necessary be disconnected from the drive shaft 18.

The carrying hub 24 is connected coaxially to the impeller 22 which is likewise made from plastic. The undetachable connection is effected by adhesive bonding.

Unintentional loosening of the carrying hub 24 with the impeller 22 is prevented by a bolt screwed into the end face of the drive shaft 18 and having a washer (not referenced).

The arrangement and the dimensions are selected in such a way that the impeller, with its end facing away from the drive shaft 18, surrounds the inlet funnel 4 with the formation of a narrow gap. Furthermore, the tubular piece 3 into which the inlet flange 4, is inserted has an internal diameter which is larger than the external diameter of the impeller and which permits the mounting and removal thereof.

The baseplate 9 is provided with a plurality of apertures 28 for the inlet of cooling air for the electromotor 17. The outlet of the air is effected via one or more exhaust tubes 26 which are closed by perforated plates (not referenced).

The housing 1 can be removed, together with the inner housing 8, with few handling operations. To do this the inlet flange 4' is first pulled out of the tubular piece 3. The bolt inserted into the end face of the drive shaft 18 and having a washer is then removed, and the impeller 22, together with the carrying hub 24 and the metal sleeve 23, are disconnected and removed from the housing 1.

The screw connections of the angle bar 16 are then undone, the other limb of the angle bar being welded to the support plate.

The screw connection of the inner housing 8 to the baseplate 9 is then undone, and the hose connections to the condensation run-off 5, to the exhaust tubes 26 and to the outlet pipe 7 are disconnected.

The housing 1, together with the inner housing, can now be lifted up, tilting it slightly, so that the front wall 19 with the strengthening plate 21 can be disconnected from the projecting end of the drive shaft 18.

After the housing 1 with the inner housing 8 has been taken off, the electromotor 17 with the terminal box 25 is freely accessible and can be overhauled or, if necessary, replaced. The drive shaft 18 furthermore carries, close behind the strengthening plate 21, a guard disc 20 which prevents air or gases from the housing 1 from penetrating through the annular gap between the carrying hub 24 and the strengthening plate 21.

Figure 2:
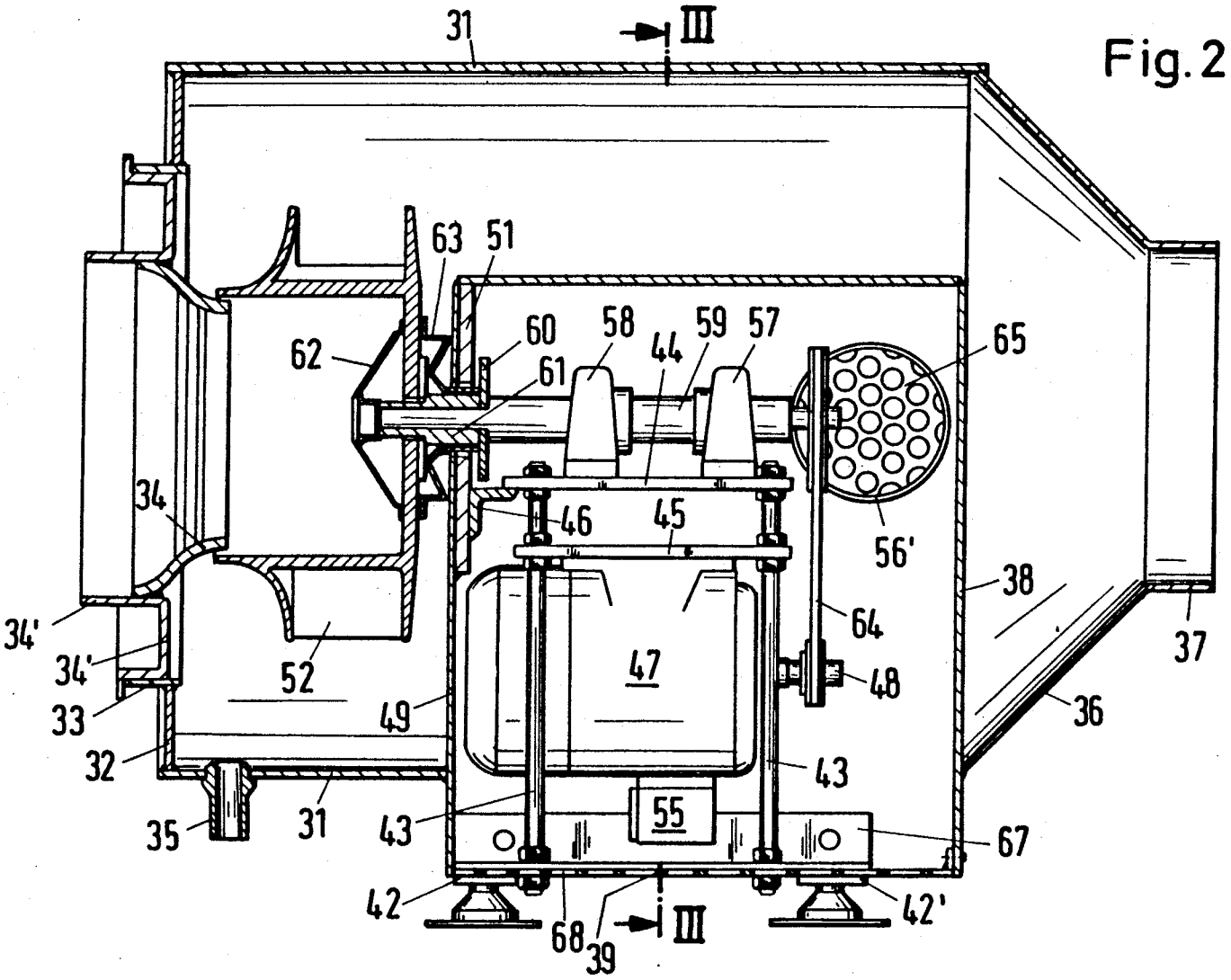
FIG. 2 shows that design of the radial fan in which a special impeller shaft is provided which is driven by the electromotor via a V-belt.

The embodiment shown in FIG. 2 differs from that according to FIG. 1 essentially in that the shaft 48 of the motor 47 is coupled to a separate impeller shaft 59 via a V-belt 64. The electromotor 47 with the terminal box 55 is again supported by four support columns 43 provided with an external screw thread and via a support plate 45 screwed rigidly to the support columns 43, whilst a further support plate 44 carries two bearing blocks 57 and 58 for an impeller shaft 59. Also in this embodiment, a metal sleeve 61, over the shouldered free end of which the impeller 52 is pushed and is rigidly connected thereto, is pushed over the free end of this impeller shaft.

In order to prevent corrosion of the metal sleeve 61 when drawing off aggressive steam, this metal sleeve is surrounded by a sealing packing 63 made from a flexible plastic and which lies at its circumference resiliently against the rear side of the impeller 52.

Furthermore, the end of the impeller shaft 59, traversing the impeller, and the metal sleeve 61 pushed over this impeller shaft are protected by a further elastic packing 62 which is fastened centrally to the impeller shaft 59 by a bolt (not shown) screwed into the end face of the impeller shaft 59.

As in the embodiment according to FIG. 1, here too a housing 31 is provided with an end wall 32 and an inserted tubular piece 33 into which an inlet flange 34' with a rigidly welded-in inlet funnel is pushed. A condensation run-off 35 ensures that any condensation water arising runs off.

At the other end, the housing 31 merges via an outlet funnel 36 into an outlet pipe 37. In the housing there is situated an inner housing 38 which is connected detachably to a baseplate 39 provided with apertures 68.

Two angle bars, one (67) of which is shown in FIG. 2, rest on the baseplate. The support columns 43 are screwed at their lower ends to the abovementioned angle bars and to crossbeams 42, 42' situated beneath the baseplate. The crossbeams 42, 42' here too rest on (not referenced) anti-vibration pads and support plates.

The inner housing 38 accommodating the electromotor 47 and the impeller shaft 59 is strengthened by a strengthening plate 51 at the point where the impeller shaft 59 passes through the front wall 49. Here too the impeller shaft 59 carries a guard disc 60 close to the aperture of the strengthening plate 51.

Figure 3:
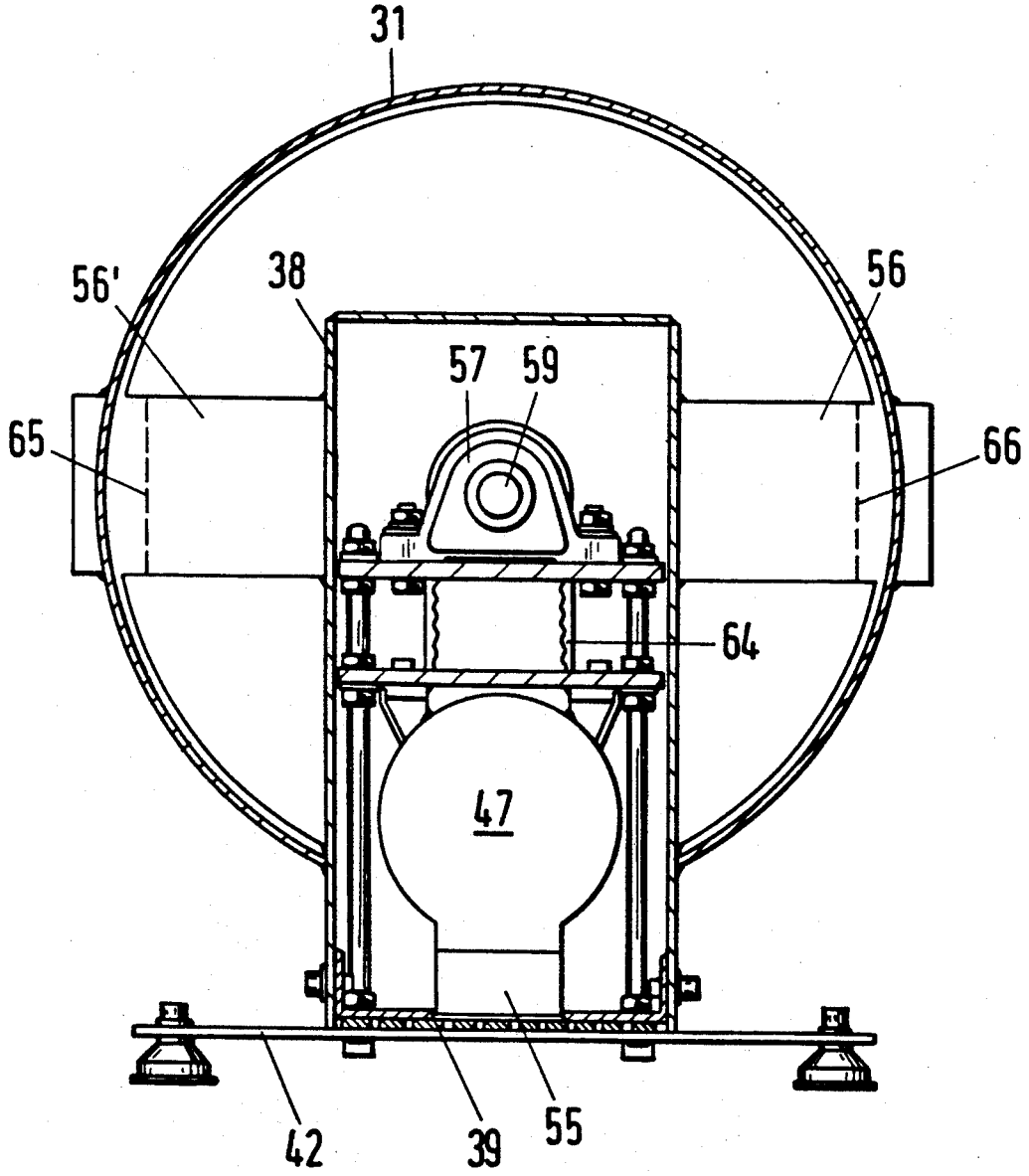
FIG. 3 shows a section along the line III—III in FIG. 2.

As can be seen from FIG. 2, and in particular from FIG. 3, two exhaust tubes 56 and 56, lead from the inner housing 38, on both sides of the impeller shaft 59, through the housing 31 to the outside in order to guide the cooling air which enters through the apertures 68 in the baseplate 39 and flows past the electromotor 47, to the open air. These two exhaust tubes are closed by perforated plates 65 and 66, especially to prevent the penetration of foreign bodies.

In this embodiment too, an angle bar 46 is provided which is welded to the support plate 44 by way of one of its limbs, whilst the other limb bears against the strengthening plate 51 and is connected to the latter by a bolt (not shown) introduced from the outside.

The above-described radial fans according to the invention can be designed both in a standard design with a horizontal or vertical installation position, and in an installation design with an additional flange, or also as a roof fan.

List of reference numerals

| | |
|---|---|
| 1, 31 | Housing |
| 2, 32 | End wall |
| 3, 33 | Tubular piece |
| 4, 34 | Inlet funnel |
| 4', 34' | Inlet flange |
| 5, 35 | Condensation run-off |
| 6, 36 | Outlet funnel |
| 7, 37 | Outlet pipe |
| 8, 38 | Inner housing |
| 9, 39 | Baseplate |
| 10 | Support plates |
| 11 | Anti-vibration pad |
| 12, 42, 42' | Crossbeams |
| 13, 43 | Support columns |
| 14, 15<br>44, 45 | Support plates |
| 16, 46 | Angle bars |

-continued

| List of reference numerals | |
|---|---|
| 17, 47 | Electromotor |
| 18, 48 | Drive shaft |
| 19, 49 | Front wall |
| 20, 60 | Guard disc |
| 21, 51 | Strengthening plate |
| 22, 52 | Impeller |
| 23, 61 | Metal sleeve |
| 24 | Carrying hub |
| 25, 55 | Terminal box |
| 26, 56, 56' | Exhaust tubes |
| 27, 67 | Angle bars |
| 28, 68 | Apertures |
| 57, 58 | Bearing blocks |
| 59 | Impeller shaft |
| 62, 63 | Sealing packings |
| 64 | V-belt |
| 65, 66 | Perforated plates |

What is claimed is:

1. A radial fan comprising an outer housing and an inner housing housed generally within said outer housing; said outer housing having a top wall, a bottom wall, opposite end walls and an inlet and an outlet in respective ones of said opposite end walls; an impeller between one of said inlet and outlet and said inner housing, a motor within said inner housing for rotating a shaft projecting through said inner housing and being in turn connected to said impeller for rotting said impeller to convey a fluid medium from said inlet to said outlet, means for rigidly connecting and unifying said inner and outer housings to each other, a base plate, a plurality of columns within said inner housing projecting upwardly from and being supported by said base plate, said columns in turn supporting said motor, and means removably securing said base plate relative to said inner housing whereby said inner and outer housings are lifted and removed as a unit from said base plate without moving said motor to gain access to said motor.

2. The radial fan as defined in claim 1 wherein said base plate is a bottom wall of said inner housing.

3. The radial fan as defined in claim 1 including aperture means in said base plate for ventilating said inner housing and a motor therein.

4. The radial fan as defined in claim 1 including aperture means in said base plate for ventilating said inner housing and a motor therein, and at least one exhaust tube for placing the inner housing in fluid communication with the exterior of said outer housing by passing through an area defined between said inner and outer housings.

5. The radial fan as defined in claim 1 wherein said shaft is directly driven by said motor.

6. The radial fan as defined in claim 1 including a support plate connected to said columns to which said motor is connected, and said inner housing including a ledge underlyingly supporting said support plate.

7. The radial fan as defined in claim 1 wherein said columns bear against the top wall of said inner housing.

8. The radial fan as defined in claim 1 wherein said shaft is driven by a drive belt which is in turn driven by said motor.

9. The radial fan is defined in claim 1 wherein said shaft is driven by a drive belt which is in turn driven by said motor, a support plate carried by said columns, and bearing means carried by said support plate for journalling said shaft.

10. The radial fan as defined in claim 2 including aperture means in said base plate for ventilating said inner housing and a motor therein.

11. The radial fan as defined in claim 2 including aperture means in said base plate for ventilating said inner housing and a motor therein, and at least one exhaust tube for placing the inner housing in fluid communication with the exterior of said outer housing by passing through an area defined between said inner and outer housings.

12. The radial fan as defined in claim 2 wherein said shaft is driven by a drive belt which is in turn driven by said motor.

13. The radial fan as defined in claim 2 wherein said motor, a support plate carried by said columns, and bearing means carried by said support plate for journalling said shaft.

* * * * *